United States Patent [19]

Pipkin

[11] Patent Number: 4,602,650

[45] Date of Patent: Jul. 29, 1986

[54] LIQUID APPLICATOR

[76] Inventor: Royace H. Pipkin, 3317 Thomas Rd., Raleigh, N.C. 27607

[21] Appl. No.: 610,024

[22] Filed: May 14, 1984

[51] Int. Cl.[4] ..... A45D 44/18

[52] U.S. Cl. ..... 132/84 R; 132/84 B; 15/176; 15/227

[58] Field of Search ..... 132/84 R, 84 A, 84 B; 15/'167 R, 167 A, 167 B, 176, 227

[56] References Cited

U.S. PATENT DOCUMENTS

| | | | |
|---|---|---|---|
| 2,686,325 | 8/1954 | Silver | 15/227 |
| 2,722,706 | 11/1955 | Chopp | 15/227 |
| 2,745,128 | 5/1956 | Zeuner | 15/227 |
| 2,763,885 | 9/1956 | Lyons | 15/227 |
| 2,883,691 | 4/1959 | Gruenwald | 15/227 |
| 2,921,590 | 1/1960 | Holton | 132/84 R |
| 2,968,827 | 1/1961 | Lawsine et al. | 15/227 |
| 2,988,049 | 6/1961 | Bean | 15/227 |
| 3,298,507 | 1/1967 | Micciche | 15/227 |
| 3,368,668 | 2/1968 | Micciche | 15/227 |
| 3,583,019 | 6/1971 | Conklin, Jr. | 15/227 |
| 3,798,698 | 3/1974 | Conklin, Jr. | 15/227 |
| 3,902,509 | 9/1975 | Tundermann et al. | 132/84 R |
| 3,934,299 | 1/1976 | Regester | 15/227 |
| 4,370,773 | 2/1983 | Hadary | 15/176 |

*Primary Examiner*—Gene Mancene
*Assistant Examiner*—Cary E. Stone
*Attorney, Agent, or Firm*—Mills and Coats

[57] ABSTRACT

This invention is a paint applicator with the normal handle portion terminating in either a finger configuration or a glove configuration to allow the bristle or applicator portion thereof to be more accurately and less tiringly manipulated.

6 Claims, 7 Drawing Figures

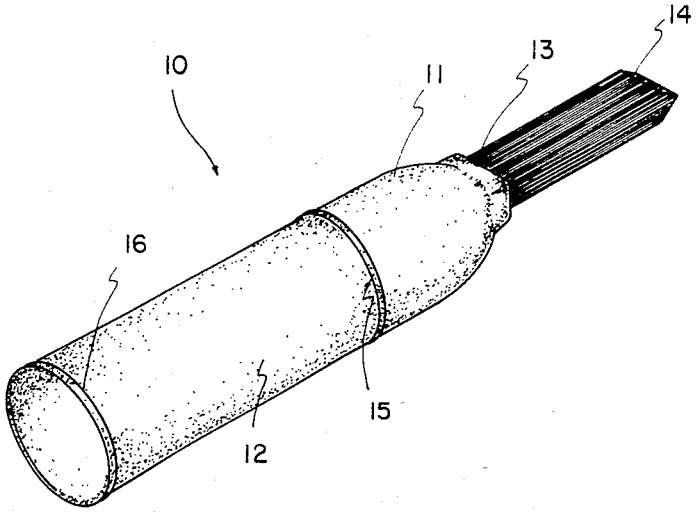
FIG. 1
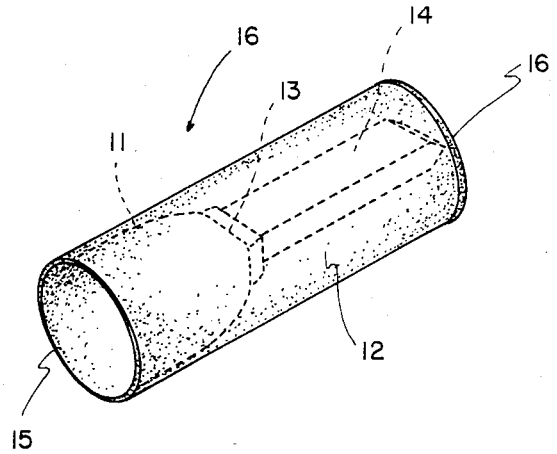
FIG. 2
FIG. 3
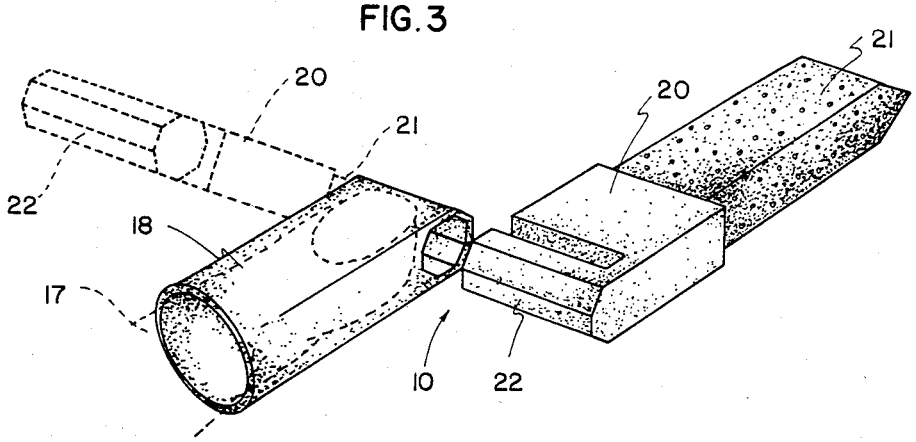

LIQUID APPLICATOR

FIELD OF INVENTION

This invention relates to paint applicators and more particularly to brush type devices mounted on one or more appendages of the user thereof.

BACKGROUND OF INVENTION

Over the years various methods of applying coats of paint have been tried and used. These include not only the brushing on of the paint coatings but also applying it through the use of roller applicators, and more recently through the use of paint sprayers.

Although rolling and spraying application is much faster than brush application, they have the disadvantage of applying a much thinner coating whereby in many instances two coats of sprayed or rolled application are required where only one coat of brush application is needed. Further, the brushing on of paint gives better adhesion, allows imperfections in the surface to be covered more completely, and one coating of brushed on paint in many instances last longer than two coatings of sprayed or rolled paint.

Because the handles of brushes are generally perpendicular to the brush head, the same must be gripped tightly. This causes the painter to tire rapidly thus substantially slowing his progress on any given job. Until now there has been no alternative except to either laboriously apply the paint with a brush or apply an inferior coating by spraying or rolling.

BRIEF DESCRIPTION OF INVENTION

After much research and study into the above-mentioned problems, the present invention has been developed to provide a means of increasing both the speed and accuracy by which paint can be applied to a surface with a brush type applicator. Additionally the present invention is less tiring to manipulate thus allowing even greater benefits to the user thereof.

The above is accomplished through the attachment of the brush or brushes to one or more finger-like sleeves which can be worn by the user. These sleeves can either fit a single appendage or can be in the form of a glove or mitt covering the entire hand of the user. In this latter instance, two or more brushes can be manipulated at the same time. If the glove-like member is liquid impervious, then the added benefit of protecting the hand of the user from becoming inadvertently paint covered is realized.

In view of the above, it is an object of the present invention to provide an improved brush type applicator for applying coats of paint or the like.

Another object of the present invention is to provide a means for increasing the speed and accuracy by which paint type coatings can be applied.

Another object of the present invention is to provide an improved brush type applicator which is less tiring to manipulate than handle type brushes.

Another object of the present invention is to provide a brush type applicator which fits onto at least one appendage of the user thereof.

Another object of the present invention is to provide a brush type applicator which fits on the finger of the user thereof.

Another object of the present invention is to provide a brush type applicator which fits on at least two fingers of the user thereof.

Another object of the present invention is to provide a brush type applicator which is operatively mounted on a glove or mitt type means.

Other objects and advantages of the present invention will become apparent from a study of the following description and the accompanying drawings which are merely illustrative of such invention.

BRIEF DESCRIPTION OF DRAWINGS

FIG. 1 is a perspective view of one form of the improved liquid applicator of the present invention;

FIG. 2 is a perspective view of the applicator shown in FIG. 1 in storage position;

FIG. 3 is an exploded perspective view of a modified version of the applicator of the present invention;

DETAILED DESCRIPTION OF INVENTION

Figure 4:
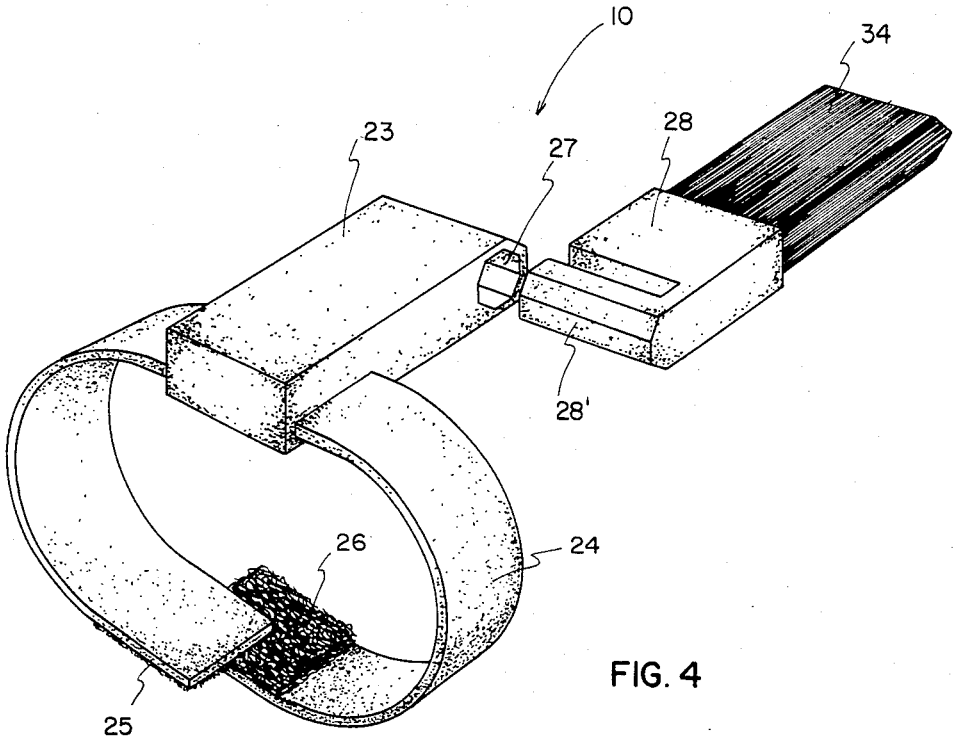
FIG. 4 is an exploded modified view of the applicator of the present invention.

With further reference to the drawings, the improved liquid applicator of the present invention, indicated generally at 10, is composed of an applicator head 11 and a mounting sleeve 12. The applicator head is preferably formed from a relatively stiff material such as plastic and is generally thimble shaped. An applicator connecting collar 13 is formed on the end of applicator head 11 and fixedly mounts one end of the liquid applicating and smoothing means such as brush 14.

Brush 14 can be either of the bristle type, can be of the open cell foam rubber type, or any other means suitable for liquid application and spreading. Since means of these types are well known to those skilled in the art, further detailed discussion of the same is not deemed necessary. Also this portion of the present invention will hereinafter be referred to as "brush" although this term is not intended to limit the present invention to any particular liquid applying and spreading means.

The mounting sleeve 12 is generally cylindrical shaped in configuration and is attached at one end to thimble shaped applicator head 11 as indicated at 15. This mounting sleeve 12 is preferably formed from surgical type rubber which is tough, liquid impervious, has a high friction coefficient, and is elastic. Thus it can be seen that when surgical rubber is used in forming mounting sleeve 12, such sleeve can stretch to accommodate many different sizes of finger appendages when in use.

At the outer end of mounting sleeve 12 is a rolled edge 16 which aids in applying and removing of the mounting sleeve from the appendage 17 of the user thereof as well as in the turning of such mounting sleeve wrong side out as shown in FIG. 2. This configuration is assumed by the present invention when the same has been cleaned after use and is stored so as to keep the brush means 14 soft and supple and to prevent the same from drying out excessively.

In the version of the present invention shown in FIG. 3, the thimble shaped applicator head is indicated at 18 and includes a hexagon-shaped-in-cross-section opening 19 extending laterally thereacross. In this version of the present invention, a mounting block 20 is provided with brush 21 outwardly extending from the end thereof. The other end of the mounting block includes a hexagon-shaped-in-cross-section mounting pin 22 which is adapted to be inserted into opening 19 of applicator head 18. Since opening 19 extends completely through the applicator head 18, the mounting pin 22 of the mounting block 20 can be inserted from either side. This reversibility is of benefit in that if two or more appendages or fingers 17 have adjacent applicators mounted thereon, the mounting blocks can be so disposed that they are inserted adjacent each other which holds each of the mounting blocks in place so long as the fingers are held fairly close to each other. Thus it can be seen that a wider or narrower swath can be formed by adding or deleting the number of fingers having applicators mounted thereon.

Another advantage of the mating hexagon shaped opening of the applicator head and the mounting pin is that the angle of the head relative to the block can be adjusted to a plurality of different angular positions in sixty degree increments. This allows the person doing the painting or applying of the liquid to set the angle of the brush relative to the finger or appendage at the most comfortable angle thus reducing fatigue and allowing faster and better work to be accomplished.

The version of the improved liquid applicator of the present invention shown in FIG. 4 includes an applicator head 23 which, instead of having a thimble shaped opening in the end thereof, has a flexible strap-like means 24 connected thereto. The exterior of one end of said strap means includes a hook material 25 secured thereto in the form of a multiplicity of small, resilient hooks. The interior of the other end of strap means 24 includes a fibrous loop material 26 secured thereto. When the resilient hook material is placed juxtaposed to the fibrous loop material and the two are pressed together, the hooks become entangled in the loops to form a relatively secure and yet releasable bond or connection. This connection is relatively easily broken by peeling the layers apart, however, sliding movement between the surfaces is extremely difficult thereby providing a relatively simple means for securing the ends of the strap means together. Securing materials of this type are sold under the brand name Velcro and is readily commercially available.

A strap means 24 is adapted to encompass the first four fingers 17 of the hand 35 of the user thereof as will hereinafter be described in greater detail relative to the version shown in FIG. 5.

A hexagon shaped opening 27 is provided in the end of applicator head 23 opposite strap means 24 and is adapted to adjustingly receive hexagon-shaped-in-cross-section mounting pin 28 of mounting block 29 in the same manner as described for the version of the present invention shown in FIG. 3.

The width of the brush means 29 can, of course, be either wider or narrower as appropriate and can be interchangeable with applicator head 18.

Figure 5:
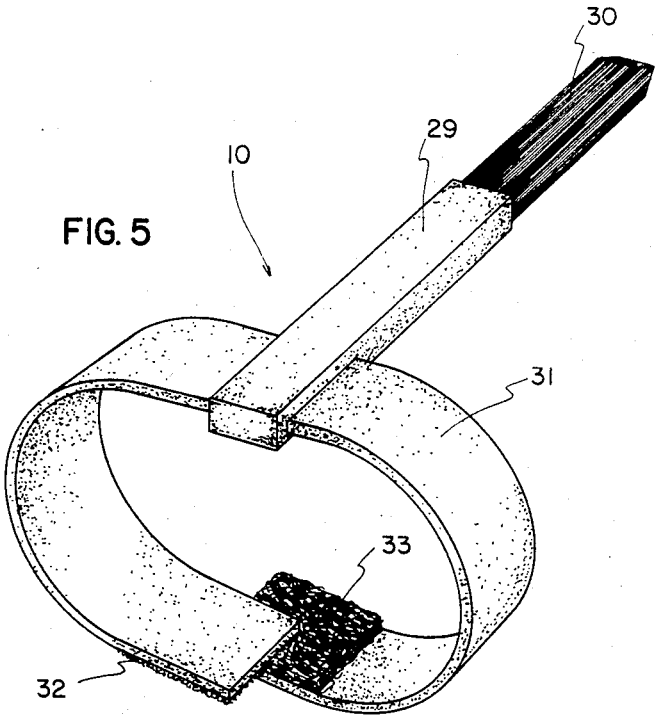
FIG. 5 is a perspective view of another modified applicator of the present invention.
Figure 6:
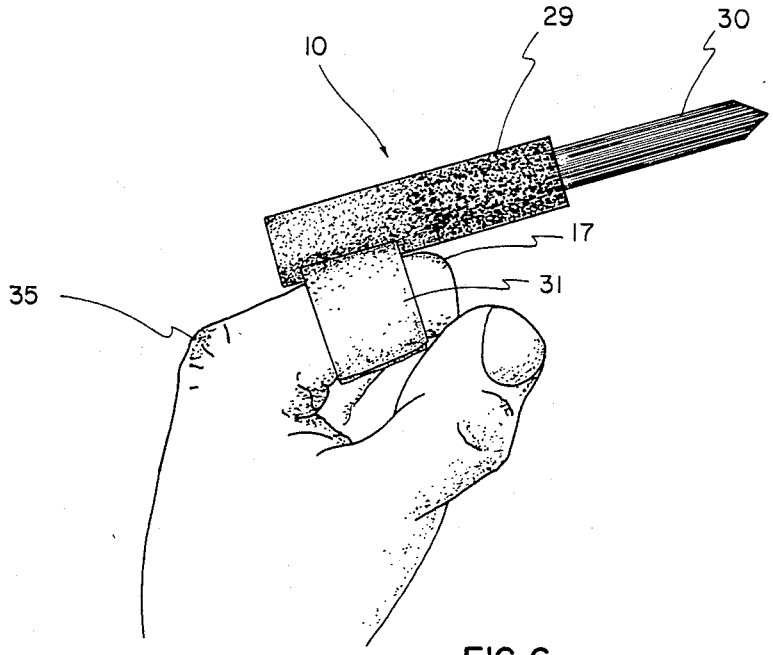
FIG. 6 is a side elevational view of the applicator of FIG. 5 showing its manner of use.

The version of the present invention shown in FIG. 5 only differs from the version shown in FIG. 4 in that the applicator head 29 has the brush means 30 mounted on the end thereof opposite strap 31. The function of this strap and its associated resilient hook material 32 and fibrous loop material 33 is the same as hereinabove described relative to strap means 24, hook material 25 and loop material 26.

To use the version of the present invention shown in either FIG. 4 or FIG. 5, the respective strap means encircles the fingers 17 of the hand 35 of the user thereof and the respective hook and loop materials are pressed together to secure the ends of such strap. The thus secured strap can be clinched in a fist like manner and the applicator means is then ready for use.

Figure 7:
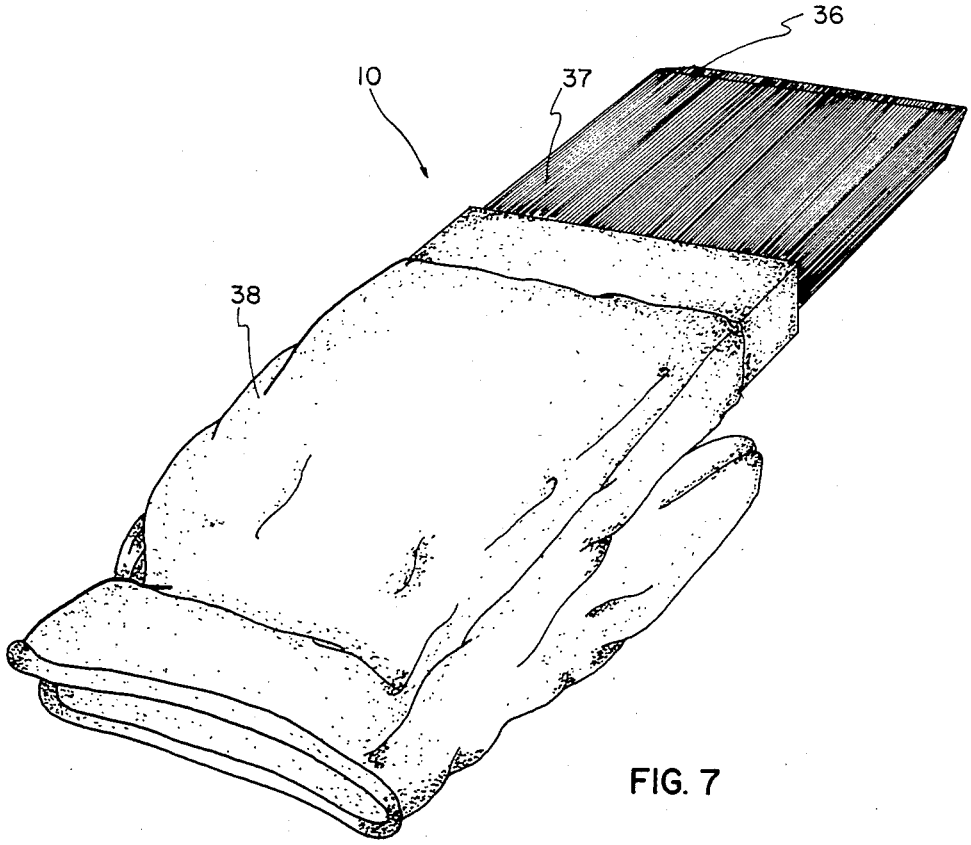
FIG. 7 is a perspective view of an even further modification of the applicator of the present invention.

In the version of the present invention shown in FIG. 7, the brush means 36 is mounted on one side of applicator head 37 with a glove shaped mounting sleeve 38 mounting on the opposite side. This glove shaped sleeve is preferably formed from surgical rubber as described for mounting sleeve 12. Also sleeve 38 can be pulled back over head 37 and brush means 36 during storage as described for the storage of brush 14.

From the above it can be seen that the present invention provides an improved applicator which is mounted on an appendage of the user thereof such as the hand, or a finger or fingers. By having the applicator so mounted, user fatigue is greatly reduced due to such user not having to grip the handle of the applicator. Also either wide or narrow swaths of the material being applied can be accomplished as well as extremely accurate trim work since, for example, only the point of the finger is required for the versions of FIGS. 1 and 3.

Also, even though relatively inexpensive to produce, the present invention in the versions shown in FIGS. 3 and 4 can have the angle of the applicating brush means varied relative to the appendage on which it is mounted for even further comfort and fatigue elimination. The present invention additionally has the advantage of keeping the appendage associated therewith from becoming covered with paint or other material, particularly as shown in the versions of FIGS. 1 and 7, as well as providing a storage means for the brush portions thereof which prevents the same from drying out and becoming otherwise degraded in condition.

The present invention can, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An improved liquid applicator comprising: an applicator head means; a brush means outwardly extending from said applicator head means; open-ended sleeve-like means secured to said applicator head means for mounting said applicator head means and associated brush means on an appendage, said sleeve-like means being reversible so as to fold back over said applicator head means and said brush means; means for adjusting the angle of disposition of said brush means with respect to said sleeve-like means; and a rolled edge extending circumferentially around said open end of said sleeve-like means to aid in applying and removing said mounting sleeve from the appendage as well as in the reversing of said mounting sleeve whereby an improved, fatigue reducing liquid applying and spreading means is provided.

2. The applicator of claim 1 wherein said brush means is of the bristle type.

3. The applicator of claim 1 wherein said brush means is of the open cell, foam rubber type.

4. The applicator of claim 1 wherein said angular adjustment is accomplished through the provision of a hexagonal-in-cross-section shaped opening in said sleeve-like means with a mating hexagonal-in-cross-section pin secured to said applicator head means for mounting said applicator head means and its associated brush means.

5. An improved liquid applicator comprising: an applicator head means having a hexagonal-in-cross-section mounting pin; brush means outwardly extending from said applicator head means; a mounting block having a hexagonal-in-cross-section shaped opening for receiving said mounting pin; and strap-like means for securing said mounting block to an appendage, whereby an improved, fatigue reducing liquid applicator is provided.

6. The improved liquid applicator of claim 5 wherein said strap-like means includes velcro type hoop and loop material for securing the same.

* * * * *